US005081743A

United States Patent [19]

Mayes

[11] Patent Number: 5,081,743

[45] Date of Patent: Jan. 21, 1992

[54] FRICTION STAY AND ADJUSTABLE FRICTION SLIDER

[76] Inventor: John Mayes, 17 Kingsmead Road, Arle, Cheltenham, Glos Gl51, United Kingdom

[21] Appl. No.: 538,878

[22] Filed: Jun. 14, 1990

[30] Foreign Application Priority Data

Jun. 20, 1989 [GB] United Kingdom ..... 8914144

[51] Int. Cl.[5] ..... E05D 11/08; E05D 15/00

[52] U.S. Cl. ..... 16/341; 16/93 R; 16/369; 16/370; 49/251

[58] Field of Search ..... 16/93 R, 341, 370, 369, 16/368, 337; 49/251

[56] References Cited

U.S. PATENT DOCUMENTS 3,097,402 7/1963 Ewing ..... 49/251

4,622,715 11/1986 Buckley ..... 16/370

FOREIGN PATENT DOCUMENTS 17562 of 1912 United Kingdom ..... 49/251

*Primary Examiner*—Robert L. Spruill

*Assistant Examiner*—Carmine Cuda

*Attorney, Agent, or Firm*—Davis & Schroeder

[57] ABSTRACT

A slider for a track, such as the track of a friction stay, comprises a slider body adapted to be slidably received in the track, and slider body includes a recess having a cam mounted therein. Rotation of the cam causes the curved portions of the cam to bear against the sides of the recess, which are thereby slightly deformed. This deformation increases the frictional engagement of the slider with the track.

18 Claims, 2 Drawing Sheets

FRICTION STAY AND ADJUSTABLE FRICTION SLIDER

BACKGROUND AND SUMMARY OF THE INVENTION

This invention relates to friction supporting stays of the type which are used for supporting windows and sometimes doors, the stay being of the kind which comprises a track, a slider movable along the track, a strut pivotally connected to the track, a brace pivotally connected between the slider and the strut, a link pivotally connected to the slider and a bar pivotally connected to the link and the strut, the arrangement being such that as the slider moves along the track the bar can swing from a position overlying the track to a position where it is angled with respect to the track.

Control of the frictional restraint of the slider in known friction stays is achieved by use of a friction pad located between the slider and the track and a grub screw (i.e. in the nature of a set screw) threaded in the body of the slider and adapted to bear directly on the friction pad so that the frictional engagement between the slider and the track may be varied. The pad bears downwardly on the base of the track which is where the frictional engagement occurs.

An object of the present invention is to provide an improved form of slider which is cheaper to produce, can be made without any metal parts if desired, and is efficient in operation.

In accordance with the present invention, there is provided a slider for a track, said slider comprising a slider body adapted to be slidably received in the track, and said body including a recess having mounted therein a cam which is rotatable so as to bear against the sides of the recess, whereby to vary the frictional engagement of the slider with the track.

Also provided in accordance with the present invention is a friction stay comprising a track, a slider comprising a slider body movable along the track, a strut pivotally connected to the track, a brace pivotally connected between the slider and the strut, a link pivotally connected to the slider and a bar pivotally connected to the link and to the strut, the arrangement being such that as the slider moves along the track the bar can swing from a position overlying the track to a position where it is angled with respect to the track, characterized in that the slider body includes a recess having mounted therein a cam which is rotatable so as to bear against the sides of the recess, whereby to vary the frictional engagement of the slider with the track.

In one embodiment, the track is of channel section, and rotation of the cam to bear against the sides of the recess causes the longitudinal edges of the slider to bear against the walls of the channel. The walls of the channel may be flanged, and the longitudinal edges of the slider may be adapted to receive said flanges.

The slider body is preferably formed from a plastics material. Acetal homopolymers and copolymers are particularly preferred because of their low friction, low wear properties.

The cam may also be made from a plastics material such as an acetal homopolymer or copolymer. Alternatively, the cam may be made from a metal such as brass, steel or a zinc alloy of the kind sold under the trademark Mazak. If desired, the cam may be zinc plated to improve corrosion resistance.

The cam preferably forms a friction fit in the recess, so that it is rotatable against the friction between the two parts, but not freely rotatable. If necessary, friction between the cam and the slider body may be increased by knurling or otherwise roughening one or both of the cooperating surfaces. For example, if a metal cam is received in an acetal slider body, the cooperating surface of the cam may conveniently be provided with knurling in a saw-tooth pattern to a depth of 0.1 mm, with a pitch of 0.2 mm. If both the cam and the slider body are formed from an acetal resin, knurling is not generally necessary.

The cam may be arranged with a downwardly projecting boss on which there is a flange engageable in a corresponding hole in the lower part of the slider body so that the cam clicks (i.e. snappably fits) into and is held in place in the slider body.

Preferably there is a drive recess or slot in the cam to enable it to be rotated and thus to vary the pressure on the sides of the recess. The recess or slot may be e.g. a hexagonal or square recess or a screwdriver slot.

In one embodiment the slider body is scalloped at its outer edges adjacent the recess so that when the cam applies pressure to the internal walls of the recess the scalloped portions tend to be straightened thus bringing a straight portion of the slider body into contact with the adjacent walls of the track. Alternatively a straight sided slider may be used or slots may be formed in the ends of the walls to allow the outwardly facing portions of the walls to bow outwardly.

The cam may, for example, be symmetrical and have two parallel straight portions joined by French curves.

DESCRIPTION OF THE DRAWING

For fuller understanding of the present invention, reference is made to the accompanying drawing in the following detailed Description of the Preferred Embodiment of the invention. In the drawing.

Figure 1:
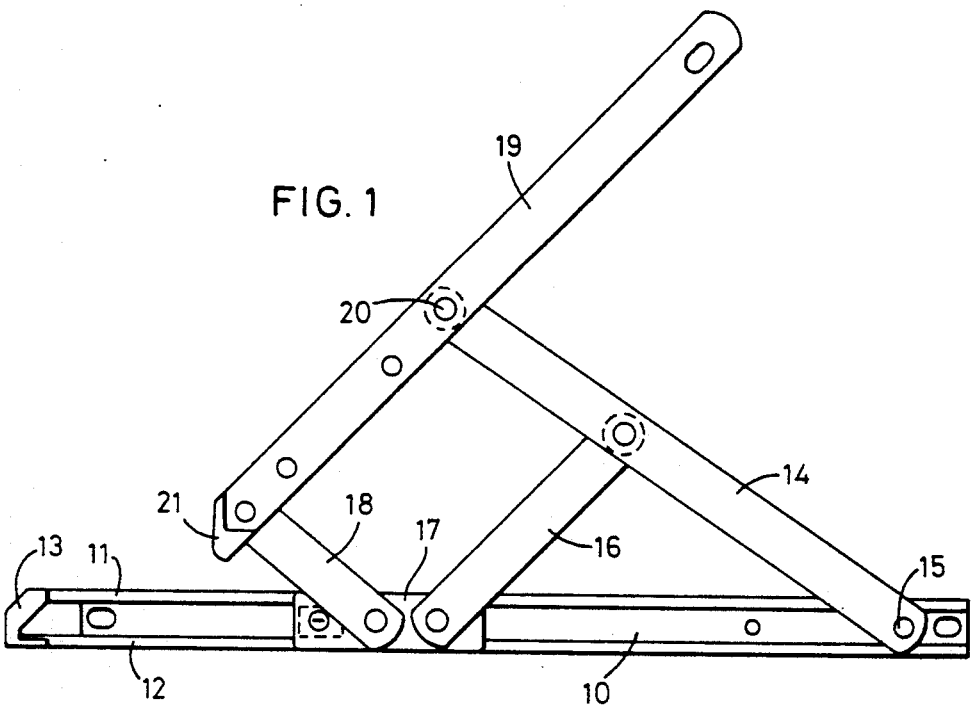
FIG. 1 is a plan view of a friction supporting stay embodying the invention.

Reference numbers refer to the same or equivalent parts of the present invention throughout the several figures of the drawing.

DESCRIPTION OF THE PREFERRED EMBODIMENT

The friction suppoting stay shown in FIG. 1 comprises a track 10 which has flanged outer walls 11 and 12 and a nose portion 13. A strut 14 is pivotally connected to the track 10 at 15. A brace 16 is pivotally connected between the strut 14 and a slider 17.

A link 18 is pivotally connected between the slider 17 and a bar 19 which is in turn pivoted at 20 to the link 14. The bar 19 carries a plastic nose portion 21.

Figure 2:
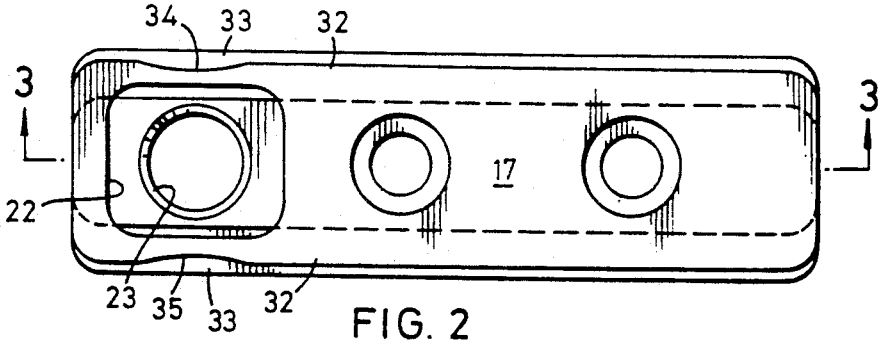
FIG. 2 is an enlarged underplan of a slider which is 35 shown in FIG. 1.
Figure 3:
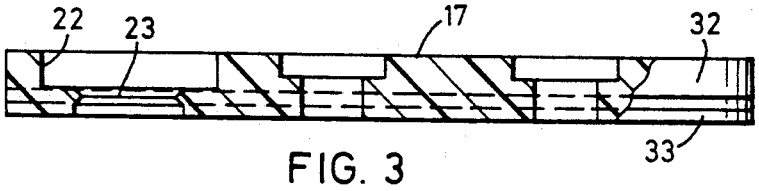
FIG. 3 is a section on line 3—3 of FIG. 2.
Figure 4:
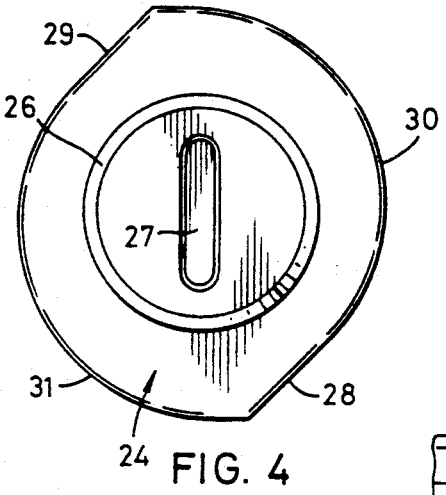
FIG. 4 is an enlarged plan view of the cam which is 5 incorporated in the slider.

The body of the slider, shown in underplan view in FIG. 2, has a recess 22 of substantially rectangular shape and the bottom of the recess is formed with a holding frame 23 adapted to receive a corresponding flange on a cam 24 shown in FIGS. 4 to 8.

Figure 5:
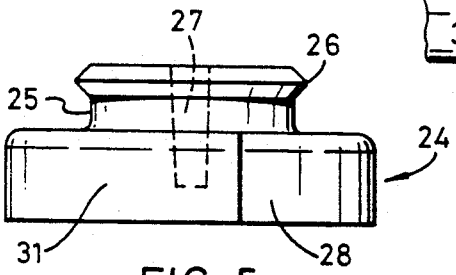
FIG. 5 is an elevation of a cam shown in FIG. 4.
Figure 8:
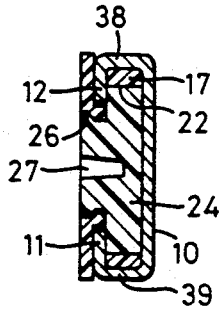
FIG. 8 is a section on line 8—8 of FIG. 7.
Figure 7:
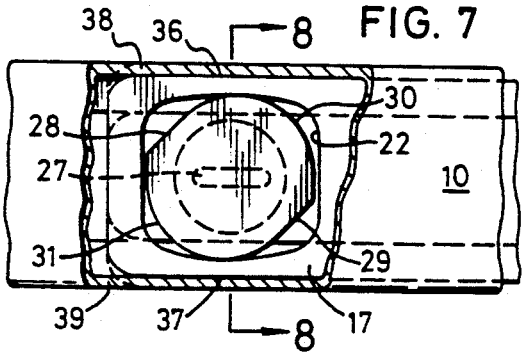
FIG. 7 is a view similar to FIG. 6 but shows the cam in its locked or engaged position.

As seen in FIG. 5, the cam 24 has a boss 25 formed at its outer end with a tapered flange 26 which is adapted to engage the flange 23 in the slider body so as to retain the cam in the slider body but to allow it to rotate when turned by a screwdriver or similar tool engagable in a slot 27. The outer surface of the cam comprises two parallel straight portions 28 and 29 joined by French curves 30 and 31.

The outer walls of the slider are formed with spaced apart parallel lips 32 and 33 which engage over the flanges 11 and 12 of the side walls of the track 10. The lips 32 are scalloped at 34 and 35 as seen in FIGS. 2 and 6.

Figure 6:
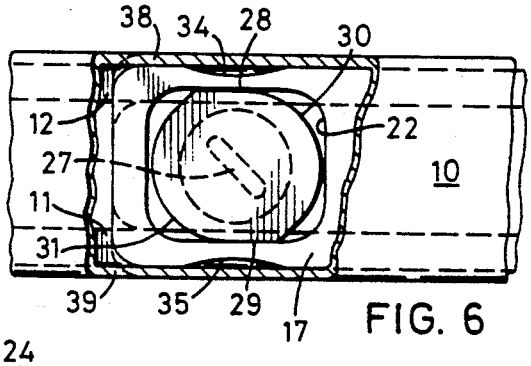
FIG. 6 is a fragmentary underplan with the track broken 10 away to show the cam in its unlocked or free position.

The cam 24 is shown in FIG. 6 with the straight portions 28 and 29 in contact with the inner walls of the recess 22. When the cam is rotated from the position shown in FIG. 6 to the position shown in FIG. 7 the curved portions 30 and 31 of the cam engage the inner walls of the recess thus forcing the scalloped lips 34 and 35 to come into contact with the inner surface of the side walls 38 and 39 of the track 17. It will be noted that the scallops have now straightened out and thus there is line frictional contact at 36 and 37 between the outer edges of the slider and the inner portions of the walls of the track. The degree of frictional contact will vary according to the position of the cam 24 and thus the resistance to movement of the slider in the track 10 can be varied so as to provide the required holding force when the friction stay is in its open position.

Figure 2A:
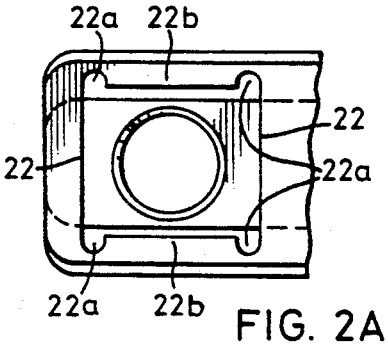
FIG. 2A is a modified version of the left-hand portion of FIG. 2.

Another arrangement which achieves a similar effect to the scallop is shown in FIG. 2A. Here the walls 22 are straight but at each end of each wall 22 is a slot 22*a* which weakens each wall 22*b* and allows it to bow outwardly when the cam 24 is rotated thus causing each wall 22*b* to grip the 30 track.

The slider body is preferably molded from plastic and may be molded in the form of a single molding which may also encompass the cam.

Whether or not the slider body and the cam are formed together in a single molding, the slider of the invention is simpler and cheaper to produce than conventional sliders. In particular, there is no need to provide a threaded hole to receive a grub screw.

In contra-distinction to known sliders used in friction 5 supporting stays, the frictional contact occurs between the slider and the side walls of the track rather than between the slider and the bottom wall of the track and thus the sliding contact surfaces are well protected against ingress of dirt and grease by the flanges of the track.

This novel slider may be applied to any supporting stay whether for windows or doors, whether for use as a horizontal or vertical support and indeed wherever variable friction is required between a slider and a track.

The invention may be applied to any of the well known Securistyle range of friction supporting stays such as those illustrated in British Patent 2081803B and European Patent 0295094.

While the present invention has been particularly shown and described with respect to certain preferred embodiments thereof, it should be readily apparent to those of ordinary skill in the art that various changes and modifications in form and details may be made without departing from the spirit and scope of the invention as set forth in the appended claims.

I claim:

1. A slider for a track, said slider comprising a slider body adapted to be slidably received in the track, and said body including a recess having mounted therein a cam which is rotatable so as to bear against the sides of the recess, said cam being adjustable to provide variation in the degree of friction between the slider and the track throughout a range of values.

2. A slider for a track, said slider comprising a slider body adapted to be slidably received in the track, and said body including a recess having mounted therein a cam which is rotatable so as to bear against the sides of the recess, whereby to vary throughout a continuous range of valves the frictional engagement of the slider with the track.

3. A slider according to claim 2 wherein the slider body is formed from plastic material.

4. A slider according to claim 2 wherein the cam is formed from plastic material.

5. A slider according to claim 2 wherein the slider body and the cam are formed from plastic material.

6. A slider according to claim 2 or claim 5 wherein the cam is provided with a downwardly projecting boss having a flange which is engageable in the slider body, such that the cam fits into and is held in place in the slider.

7. A slider according to claim 6 wherein said cam is provided with a drive recess in its upper surface.

8. A slider according to claim 6 wherein the side walls of the recess are formed with weakened portions to allow deformation of said side walls in response to rotation of the cam.

9. A slider according to claim 2 or claim 5 wherein said cam is provided with a drive recess in its upper surface.

10. A slider according to claim 9 wherein said drive recess is a slot.

11. A slider according to claim 9 wherein the side walls of the recess are formed with weakened portions to allow deformation of said side walls in response to rotation of the cam.

12. A slider according to claim 2 or claim 5 wherein the side walls of the recess are formed with weakened portions to allow deformation of said side walls in response to rotation of the cam.

13. A friction stay comprising a track, a slider comprising a slider body movable along the track, a strut pivotally connected to the track, a brace pivotally connected between the slider and the strut, a link pivotally connected to the slider and a bar pivotally connected to the link and to the strut, the arrangement being such that as the slider moves along the track the bar can swing from a position overlying the track to a position where it is angled with respect to the track, characterized in that the slider body includes a recess having mounted therein a cam which is rotatable so as to bear against the sides of the recess, whereby to vary throughout a continuous range of valves the frictional engagement of the slider with the track.

14. A friction stay according to claim 13 wherein the track is of channel section, and rotation of the cam to bear against the sides of the recess causes the longitudinal edges of the slider to bear against the walls of the channel.

15. A friction stay according to claim 14 wherein the walls of the channel are flanged, and the longitudinal edges of the slider are adapted to receive said flanges.

16. A friction stay according to any one of claims 13–15, wherein:

said slider comprises a slider body and cam formed from plastic materials;

said cam includes a downwardly projecting boss having a flange which is engageable in said slider body such that the cam fits into and is held in place in said slider;

said cam is provided with a drive recess in its upper surface; and the side walls of said recess are formed with weakened portions to allow deformation of said side walls in response to rotation of said cam.

17. A slider according to claim 16 wherein said drive recess is a slot.

18. A slider according to claim 2, 13 or 1 wherein the range of values is continuous from unlocked to locked.

* * * * *

UNITED STATES PATENT AND TRADEMARK OFFICE

CERTIFICATE OF CORRECTION

PATENT NO. : 5,081,743

DATED : JANUARY 21, 1992

INVENTOR(S) : JOHN MAYES

It is certified that error appears in the above-identified patent and that said Letters Patent is hereby corrected as shown below:

On the title page, after "[76] Inventor: John Mayes, 17 Kingsmead Road, Arle, Cheltenham, Glos G151, United Kingdom" insert -- [73] Assignee: Securistyle Limited, Nottingham, United Kingdom --.

Signed and Sealed this

Eighth Day of March, 1994

Bruce Lehman

*Attest:*

BRUCE LEHMAN

*Attesting Officer*

*Commissioner of Patents and Trademarks*